US008904698B2

(12) United States Patent
Riley et al.

(10) Patent No.: US 8,904,698 B2
(45) Date of Patent: Dec. 9, 2014

(54) MODULAR POWER SUPPLY FOR USE IN A WEAPON MOUNTABLE DESIGNATOR/ILLUMINATOR UNIT

(75) Inventors: Louis F. Riley, Weston, FL (US); Juan Carlos Casas, Coral Gables, FL (US)

(73) Assignee: Juan Carlos Casas, Coral Gables, FL (US)

( * ) Notice: Subject to any disclaimer, the term of this patent is extended or adjusted under 35 U.S.C. 154(b) by 93 days.

(21) Appl. No.: 13/406,354

(22) Filed: Feb. 27, 2012

(65) Prior Publication Data

US 2012/0216440 A1 Aug. 30, 2012

Related U.S. Application Data

(60) Provisional application No. 61/446,518, filed on Feb. 25, 2011.

(51) Int. Cl.
*F41G 1/00* (2006.01)
*F41G 1/35* (2006.01)

(52) U.S. Cl.
CPC ..... *F41G 1/35* (2013.01)
USPC ..... 42/146; 362/110; 362/113; 362/114

(58) Field of Classification Search
CPC ..... F41G 1/35; F41G 11/003
USPC ..... 42/146; 362/109–114
See application file for complete search history.

(56) References Cited

U.S. PATENT DOCUMENTS 3,867,764 A * 2/1975 Dunmire et al. ..... 42/115
4,161,835 A * 7/1979 Lough ..... 42/114
5,113,326 A * 5/1992 Maglica ..... 362/158
5,279,061 A * 1/1994 Betz et al. ..... 42/132
5,685,106 A * 11/1997 Shoham ..... 42/116
6,023,875 A * 2/2000 Fell et al. ..... 42/146
6,142,650 A 11/2000 Brown et al.
6,196,702 B1 * 3/2001 Krietzman ..... 362/259
6,431,732 B1 8/2002 Brown et al.
6,616,301 B2 9/2003 Brown et al.
6,714,564 B1 * 3/2004 Meyers ..... 372/9
6,799,868 B2 10/2004 Brown et al.
7,753,549 B2 7/2010 Solinsky et al.
7,819,547 B1 * 10/2010 Teetzel et al. ..... 362/206
7,837,346 B2 * 11/2010 Griffin ..... 362/191
7,954,273 B1 * 6/2011 Swan ..... 42/115
2003/0189826 A1 * 10/2003 Yoon ..... 362/205
2004/0060222 A1 * 4/2004 Oz ..... 42/146
2009/0116231 A1 * 5/2009 Miller ..... 362/208

(Continued)

*Primary Examiner* — Samir Abdosh
(74) *Attorney, Agent, or Firm* — Hartman Global IP Law; Gary M. Hartman; Michael D. Winter

(57) ABSTRACT

A weapon-mountable designator/illuminator unit having a light source adapted to generate a light beam in a direction away from the unit. The light beam is variable between a collimated light beam and a divergent light beam for, respectively, designating a target and illuminating a target area of the weapon. At least a first modular power supply is adapted for installation in the designator/illuminator unit. The power supply includes a cage adapted to receive a power source, a first end adapted to be received within the designator/illuminator unit, and an end cap adapted to be exposed when the power supply is assembled with the unit. The power supply is adapted to deliver power from its power source to the light source of the designator/illuminator unit. The end cap may contain a light source for generating a light beam in addition to the light beam generated by the designator/illuminator unit.

1 Claim, 9 Drawing Sheets

(56) References Cited

U.S. PATENT DOCUMENTS

2009/0241357 A1 10/2009 Raschella et al.
2010/0275496 A1 11/2010 Solinsky et al.
2011/0047850 A1* 3/2011 Rievley et al. ..... 42/72
2011/0114811 A1* 5/2011 Griffin ..... 248/316.1
2011/0167707 A1 7/2011 Gross et al.
2011/0167708 A1 7/2011 Cheng
2011/0255270 A1 10/2011 Gross et al.
2011/0314720 A1 12/2011 Cheng

* cited by examiner

MODULAR POWER SUPPLY FOR USE IN A WEAPON MOUNTABLE DESIGNATOR/ILLUMINATOR UNIT

CROSS REFERENCE TO RELATED APPLICATIONS

This application claims the benefit of U.S. Provisional Application No. 61/446,518, filed Feb. 25, 2011, the contents of which are incorporated herein by reference.

BACKGROUND OF THE INVENTION

Weapon-mountable optical sights and especially laser sights are becoming more commonly used on firearms, including handguns, long guns, and automatic weapons, air guns including air pistols and air rifles, airsoft guns, and various other types of equipment. Lasers emit a beam of coherent light that is concentrated and unidirectional, and therefore preferred for targeting use over other forms of light that are incoherent, relatively weak, and omni-directional.

In most cases, a laser sight is mounted to a scope to emit a laser light beam parallel to the axes of the scope and barrel from which a projectile is fired. The laser light appears as a small spot over long distances, enabling the user to place the spot on a target viewed through the reticle of the scope and, in doing so, indicate the trajectory of the projectile. In this sense, the laser sight is commonly described as a "laser designator."

Whereas most laser sights use a red laser diode, infrared diodes and other laser light colors have been used, including green laser diodes. Green laser light beams, for example DPSS (diode-pumped solid-state) lasers, emit a laser light beam having a wavelength of 532 nm, which is advantageous because green light is at the peak of the human eye's sensitivity, thereby producing more visible light with less energy compared to other light sources. Such efficiencies reduce the power requirements of the laser, and therefore increase battery life. A commercial example of a laser designator using this technology is the ND-3® and ND-5® series available from Laser Genetics, Inc. In addition to generating a small diameter laser light beam for use as a laser designator, these products incorporate an optical collimator that enables the beam diameter to be increased to illuminate a much larger area. In this sense, the laser sight can also be described as providing a "laser illuminator" capability. The term "laser designator/illuminator" will be used herein to refer to laser technologies that provide a laser designator and/or laser illuminator capability.

Various other weapon-mountable optical sights have been proposed, for example, as represented in U.S. Published Patent Application Nos. 2011/0314720, 2011/0167708, 2011/0167707 and 2011/0047850. For example, 2011/0314720 discloses a laser sighting device that includes an ocular lens, a laser locator, and an illuminator unit adapted to be mounted on a weapon, 2011/0167707 discloses a tactical illuminator having a foregrip, power source, aiming laser, and illuminator, and 2011/0047850 discloses a weapon-mountable foregrip assembly that includes a built-in aiming laser and power source. However, still greater versatility would be desirable, particularly for weapons that may be used in multiple different tactical missions.

BRIEF DESCRIPTION OF THE INVENTION

The present invention provides an interchangeable, modular power supply equipped for installation in a weapon-mountable designator/illuminator unit.

According to one aspect of the invention, a weapon-mountable designator/illuminator unit that is adapted for mounting on a weapon comprises a light source adapted to generate a light beam emitted in a direction away from the designator/illuminator unit. The light beam is variable between a collimated light beam and a divergent light beam for, respectively, designating a target and illuminating a target area of the weapon. The designator/illuminator unit includes at least a first modular power supply that includes a cage having first and second ends and defines a compartment therebetween that is adapted to receive a power source. The first end of the cage is adapted to be received within the designator/illuminator unit when the first modular power supply is assembled therewith, and an end cap is affixed to the second end of the cage and is adapted to be exposed when the first modular power supply is assembled with the designator/illuminator unit. The first modular power supply is adapted to deliver power from the power source to the light source of the designator/illuminator unit.

According to another aspect of the invention, a second modular power supply can be provided that is completely interchangeable with the first. Furthermore, the first and/or second modular power supply may be equipped with a light source, and the light beam(s) generated by the light source(s) may be collimated or divergent. The light beam generated by either of the modular power supplies may be adapted to overlap the collimated and divergent light beams of the designator/illuminator unit, or only the divergent light beam of the designator/illuminator unit.

Additional aspects of the invention include methods of operating a designator/illuminator unit equipped with at least the first modular power unit comprising the elements noted above for the purpose of designating and/or illuminating a target.

A technical effect of the invention is the ability of a designator/illuminator unit to be mounted on a weapon and its operation adapted to multiple different tactical missions, and the additional ability of an interchangeable modular power supply to further promote this adaptability in terms of providing varying degrees of illumination. In preferred embodiments, the modular power supplies provide for a user-selectable means of utilizing one or more additional lighting methods to designate and/or illuminate a target or target area. As such, the modular power supplies are well suited for use in a variety of missions, including those requiring flood illumination of an area or target, or designation of a target with a collimated light beam, or simply pointing or marking a target.

Other aspects and advantages of this invention will be better appreciated from the following detailed description.

DETAILED DESCRIPTION OF THE INVENTION

Figure 2:
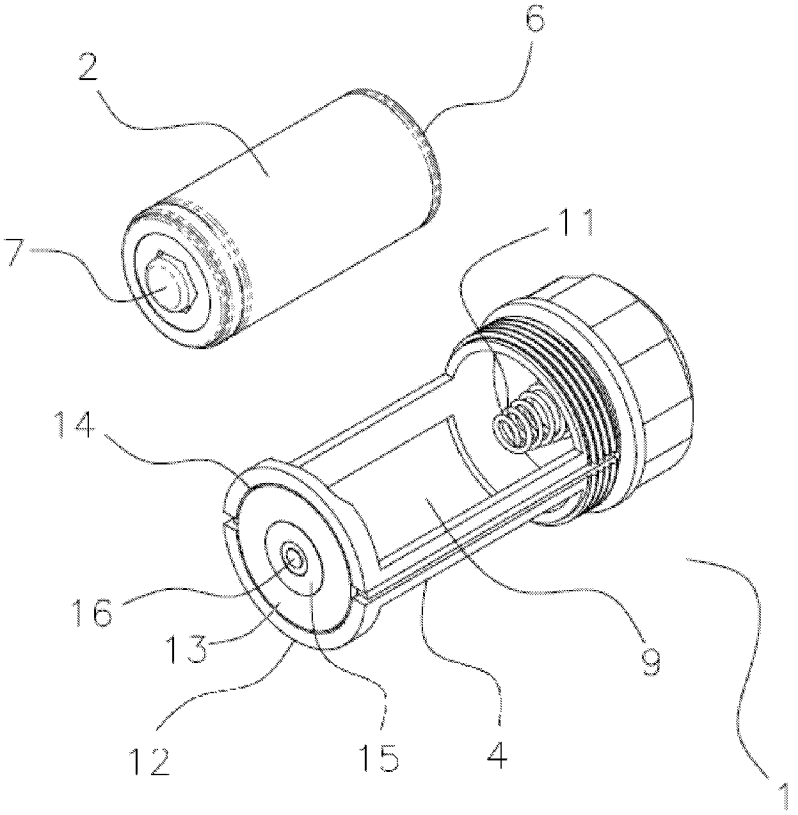
FIG. 2 is a rear perspective view of the modular power supply of FIG. 1.

FIGS. 1 through 10 schematically represent modular power supplies 1 adapted for installation in and powering a weapon-mountable designator/illuminator, an example of which is a weapon-mountable designator/illuminator unit 17 represented in FIGS. 3 through 10. The designator/illuminator unit 17 is preferably adapted for use in combination with a telescopic sight (scope) mounted to the same weapon, nonlimiting examples of which include handguns, long guns, and automatic weapons, air guns including air pistols and air rifles, airsoft guns, and various other types of weapons that may be suitable for military, hunting or recreational uses.

The designator/illuminator unit 17 is preferably capable of alternating between producing a collimated designator-style light beam 19 (FIGS. 4, 6, 8 and 10) and a divergent illuminator-style light beam 23 (FIGS. 5, 6, 8 and 10). In preferred embodiments of the invention, the designator/illuminator unit 17 utilizes a laser as a coherent light source that produces the collimated designator-style light beam 19, in which case the laser light source is also coupled with an optical collimator (not shown) capable of increasing the diameter of the laser light beam to selectively produce the divergent illuminator-type light beam 23. Commercial examples of this technology include the ND-3® and ND-5® series of designators/illuminators available from Laser Genetics, Inc., and therefore the optical collimator will not be discussed in any detail here. It is foreseeable that an incoherent light source could be used in combination with an optical collimator to selectively produce suitable collimated designator-style and divergent illuminator-style light beams.

Figure 5:
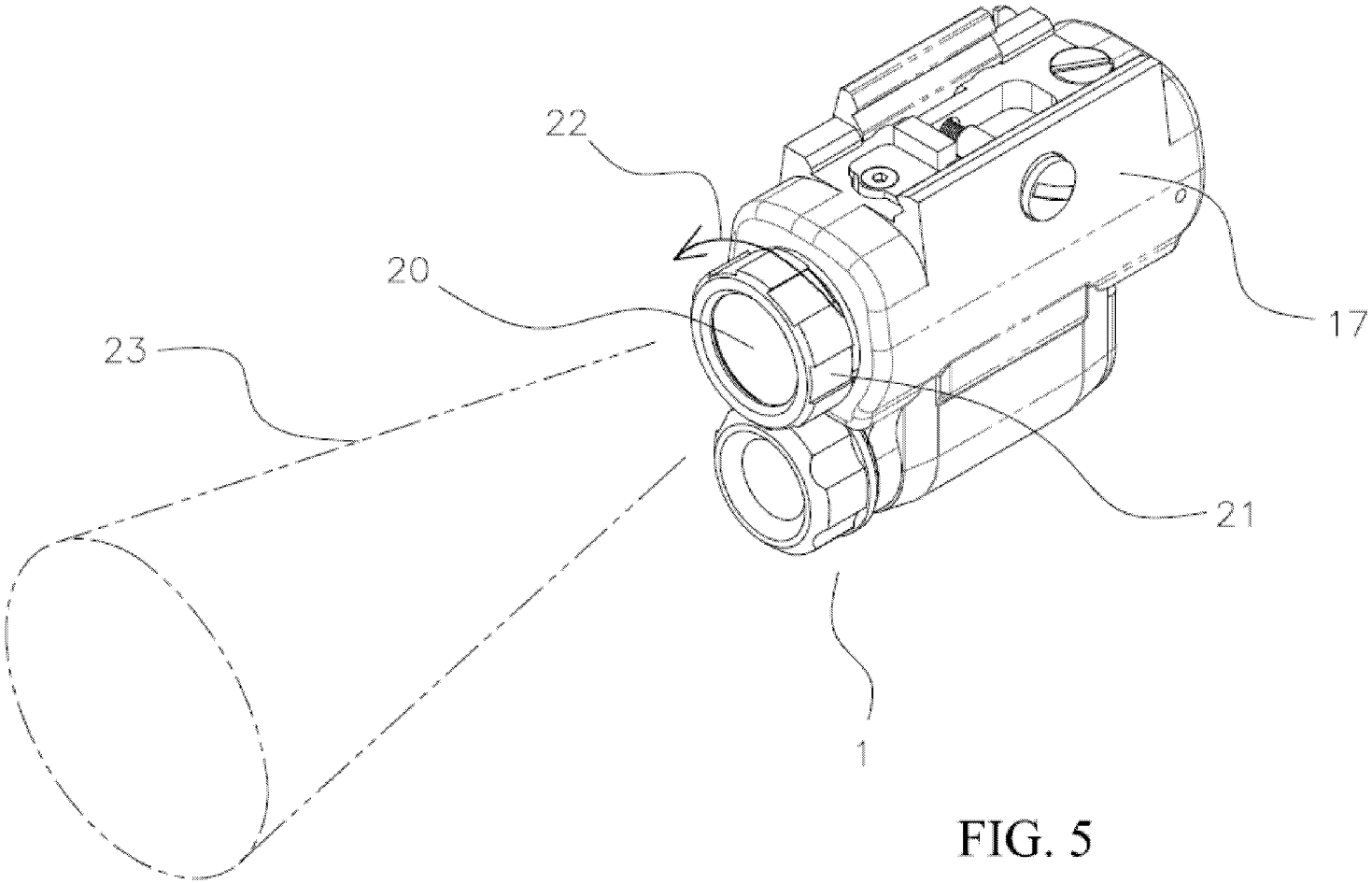
FIG. 5 is a perspective view showing the weapon-mountable designator/illuminator unit of FIG. 3 producing a divergent illuminator-style light beam following installation of the modular power supply of FIGS. 1 through 3.
Figure 6:
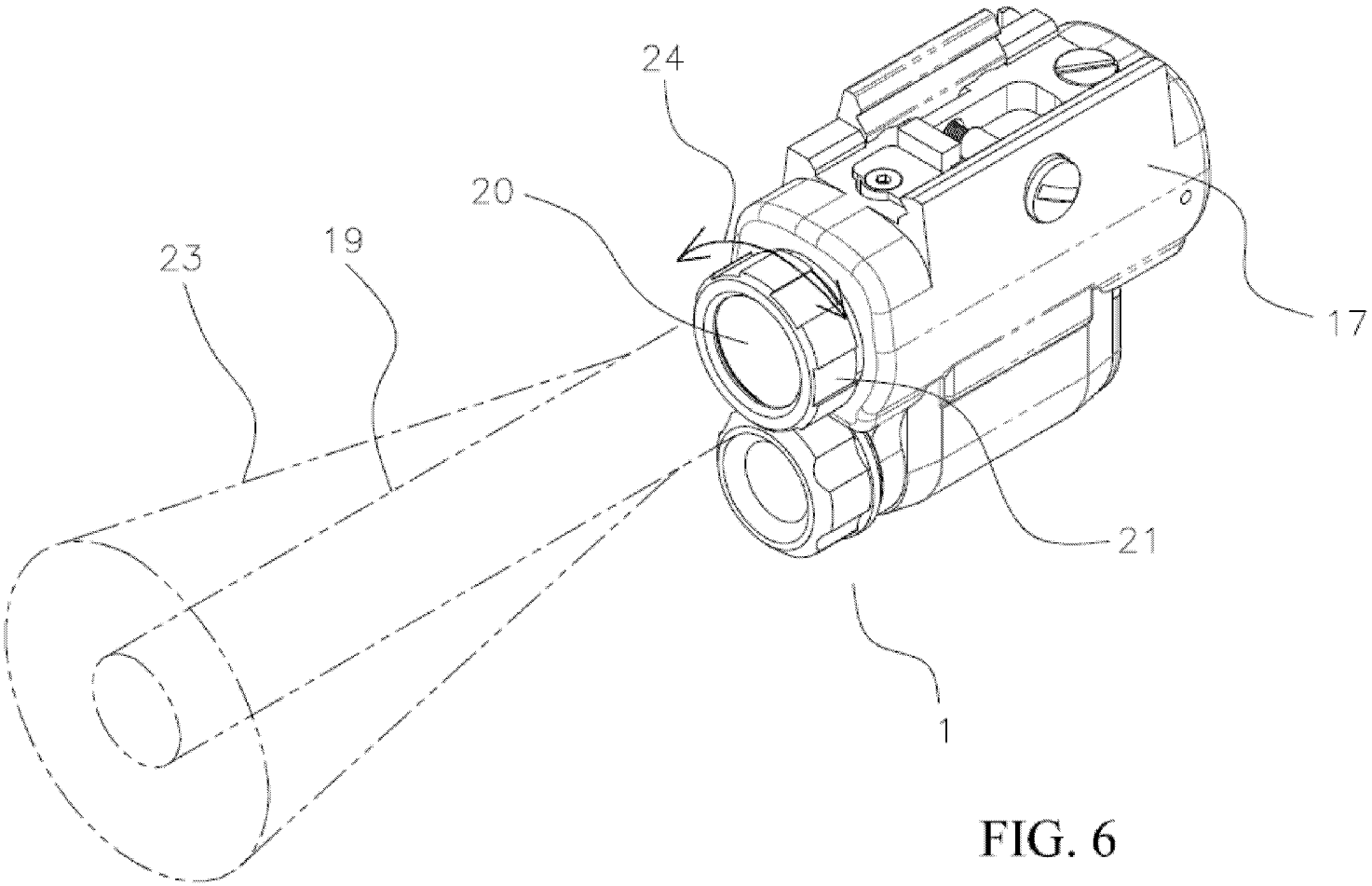
FIG. 6 is a perspective view representing the ability of the weapon-mountable designator/illuminator unit of FIG. 3 to alternate between producing a collimated designator-style light beam and a divergent illuminator-style light beam following installation of the modular power supply of FIGS. 1 through 3.
Figure 7:
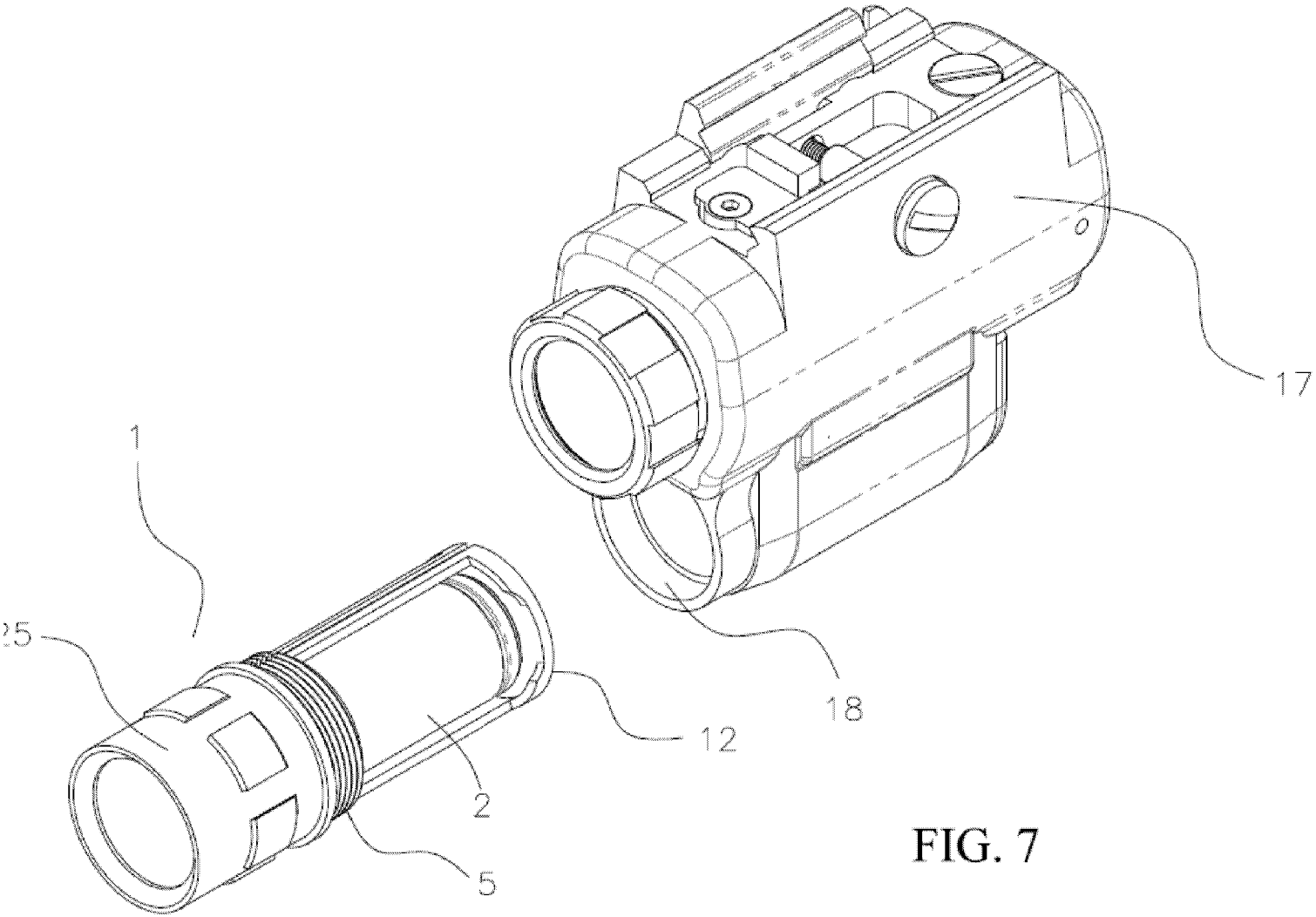
FIG. 7 is a perspective view of an alternative embodiment of a modular power supply that further incorporates a light source and is positioned for installation in a weapon-mountable designator/illuminator unit.
Figure 8:
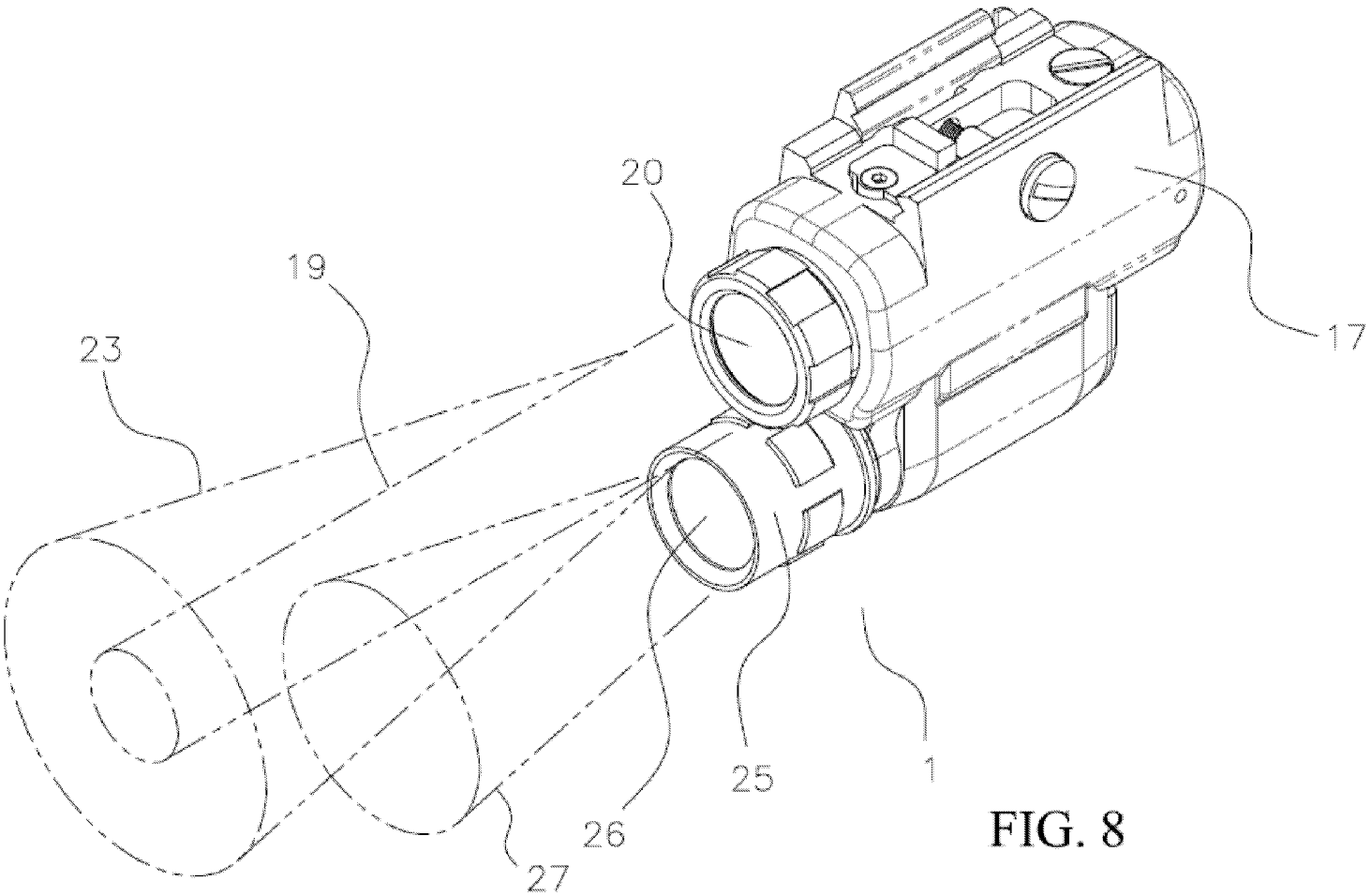
FIG. 8 is a perspective view of the weapon-mountable designator/illuminator unit of FIG. 7 following installation of the modular power supply of FIG. 7, and represents the light source of the modular power supply generating a divergent illuminator-type incoherent light beam in combination with the ability of the weapon-mountable designator/illuminator unit to alternate between producing a collimated designator-style light beam and a divergent illuminator-style light beam.
Figure 9:
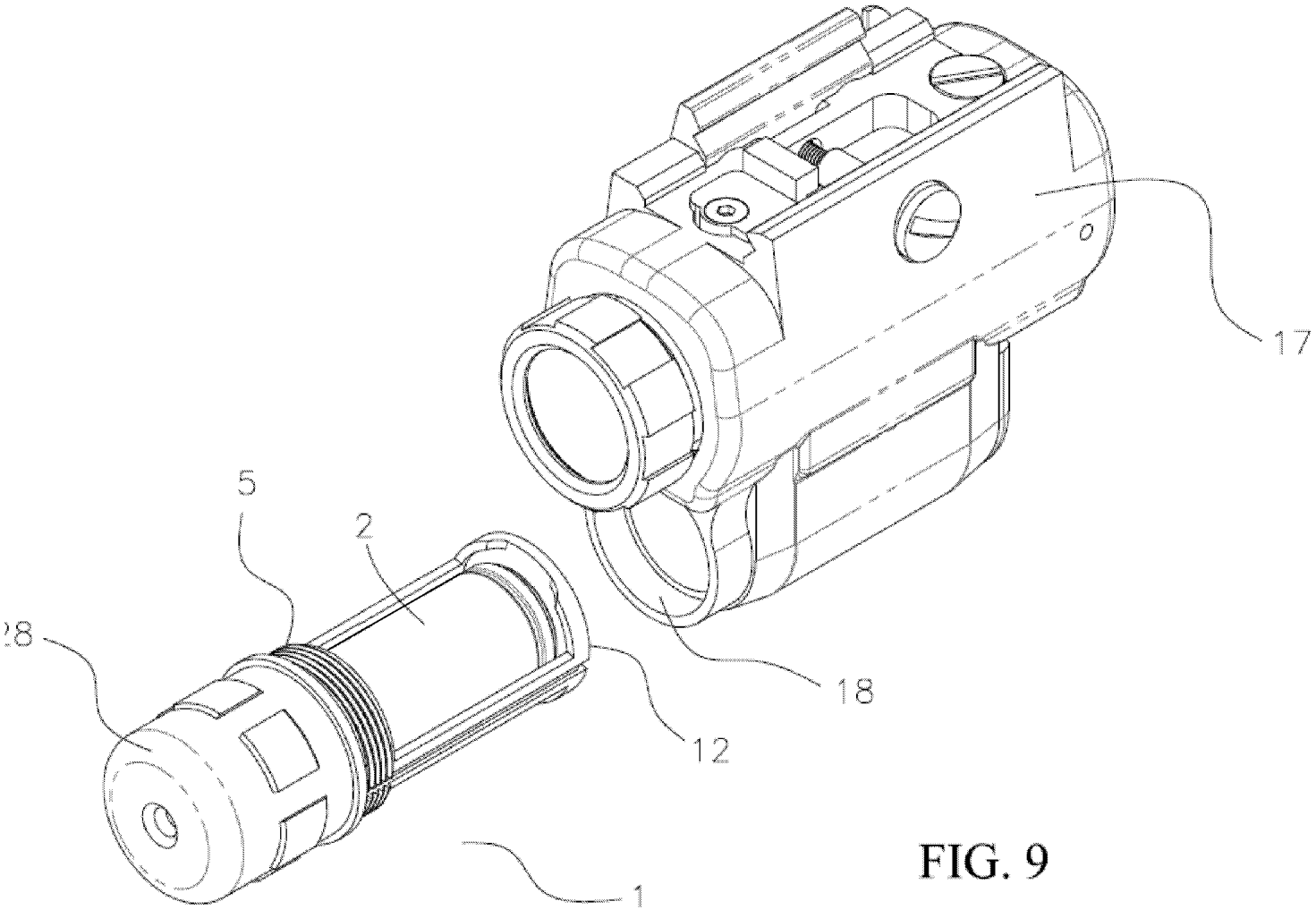
FIG. 9 is a perspective view of another alternative embodiment of a modular power supply that further incorporates a light source and is positioned for installation in a weapon-mountable designator/illuminator unit.
Figure 10:
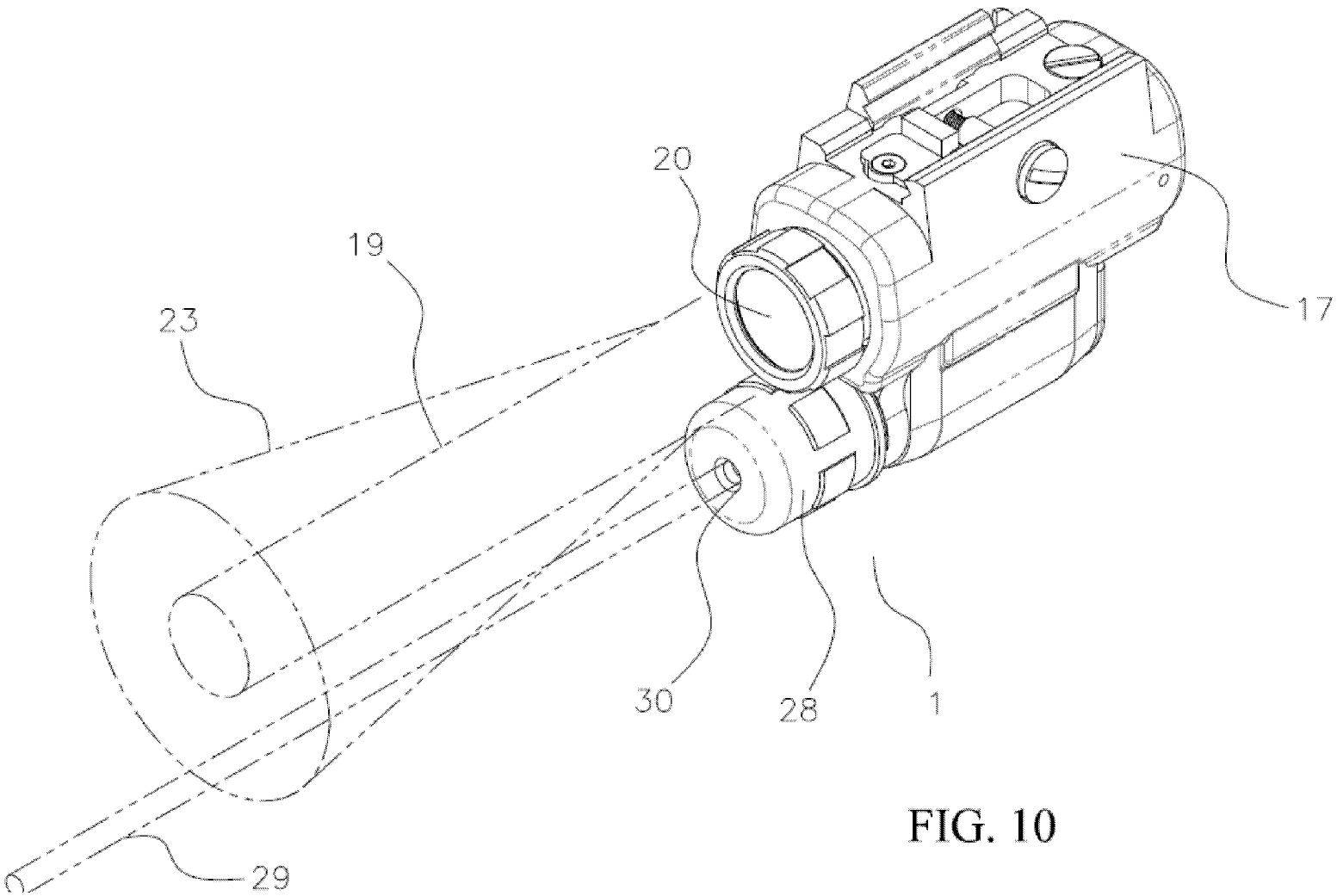
FIG. 10 is a perspective view of the weapon-mountable designator/illuminator unit of FIG. 9 following installation of the modular power supply of FIG. 9, and represents the light source of the modular power supply generating a highly collimated designator-type coherent light beam in combination with the ability of the weapon-mountable designator/illuminator unit to alternate between producing a collimated designator-style light beam and a divergent illuminator-style light beam.

According to a preferred aspect of the invention, the modular power supplies 1 of FIGS. 1 through 6, 7 through 8, and 9 through 10 are adapted to be interchangeable in the same designator/illuminator unit 17 or similarly configured designator/illuminator units. The modular power supplies 1 of FIGS. 7 through 10 are further equipped with a light source that may generate a divergent illuminator-type light beam 27 (FIG. 8) or a highly-collimated designator-type light beam 29 (FIG. 10) that is preferably distinguishable from the light beams 19 and 23 generated by the designator/illuminator unit 17. In preferred embodiments of the invention, the light source of FIGS. 7 and 8 is an incoherent light source that generates a divergent illuminator-type incoherent light beam 27, and the light source of FIGS. 9 and 10 is a coherent light source that generates a highly-collimated designator-type coherent light beam 29 of a color that is different from the light beams 19 and 23 generated by the designator/illuminator unit 17. However, it is foreseeable that an incoherent light source could be used in combination with an optical collimator capable of narrowing an incoherent light beam to generate a suitable collimated designator-style light beam 29, and a coherent light source could be used in combination with an optical collimator capable of increasing the diameter of a coherent light beam to generate a suitable divergent illuminator-style light beam 27.

Nonlimiting examples of incoherent light sources suitable for use with the modular power supply 1 of FIGS. 7 and 8 include light-emitting diodes (LEDs), incandescent bulbs, and other incoherent lighting technologies. Preferred coherent light sources used with the designator/illuminator unit 17 and modular power supply 1 of FIGS. 9 and 10 comprise a DPSS laser capable of generating a continuous wave (CW) laser beam whose coherent nature provides for greater light intensities over much farther distances as compared to LEDs, incandescent bulbs, and other more traditional incoherent lighting technologies. As noted above, the laser light beams generated by the designator/illuminator unit 17 and modular power supply 1 are preferably distinguishable from each other, for example, as a result of having different wavelengths (color). For example, the laser beams 19 and 23 generated by the designator/illuminator unit 17 may be a green laser light beam having a wavelength of 532 nm, in which case the laser light beam 29 generated by the power supply 1 would have a different wavelength. The wavelength of any one or more of the laser beams 19, 23 and 29 generated by the designator/illuminator unit 17 and power supply 1 could be selected to coincide with the peak sensitivity of an imaging device, for example, night vision goggles.

When installed on a weapon, the designator/illuminator unit 17 and its interchangeable modular power supplies 1 enable the use of different combinations of divergent and/or collimated coherent and/or incoherent light beams to designate and/or illuminate a target, which vastly increases the versatility of the weapon for use in multiple different tactical missions. Such a capability enables the designator/illuminator unit 17 and its modular power supplies 1 to serve as a designator/illuminator for selectively lighting (designating) a limited portion of the optical field of view of a scope, or lighting (illuminating) a much larger portion of the field of view.

Figure 1:
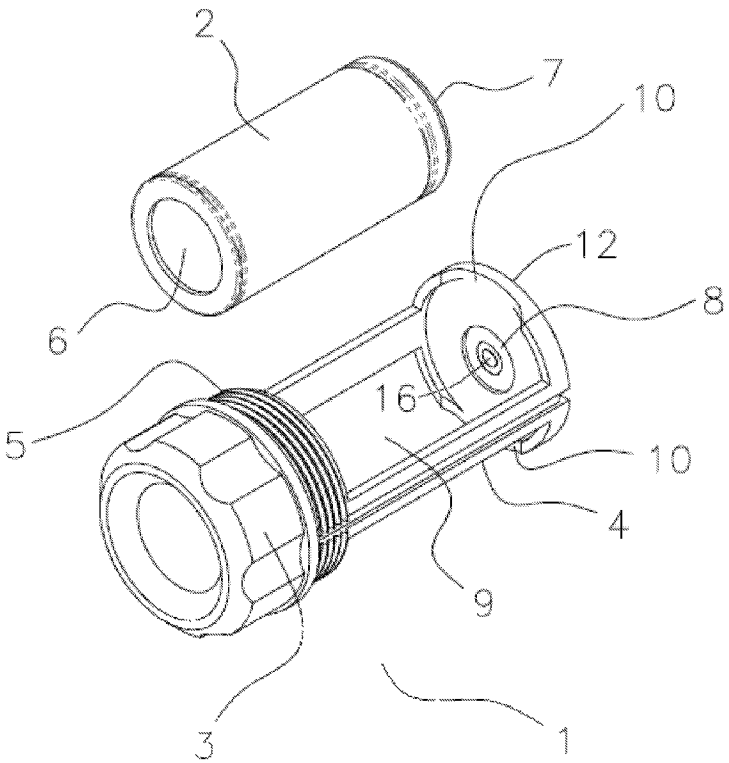
FIG. 1 is a front perspective view of a modular power supply adapted to be interchangeably installed in a weapon-mountable designator/illuminator unit in accordance with an embodiment of the present invention.
Figure 3:
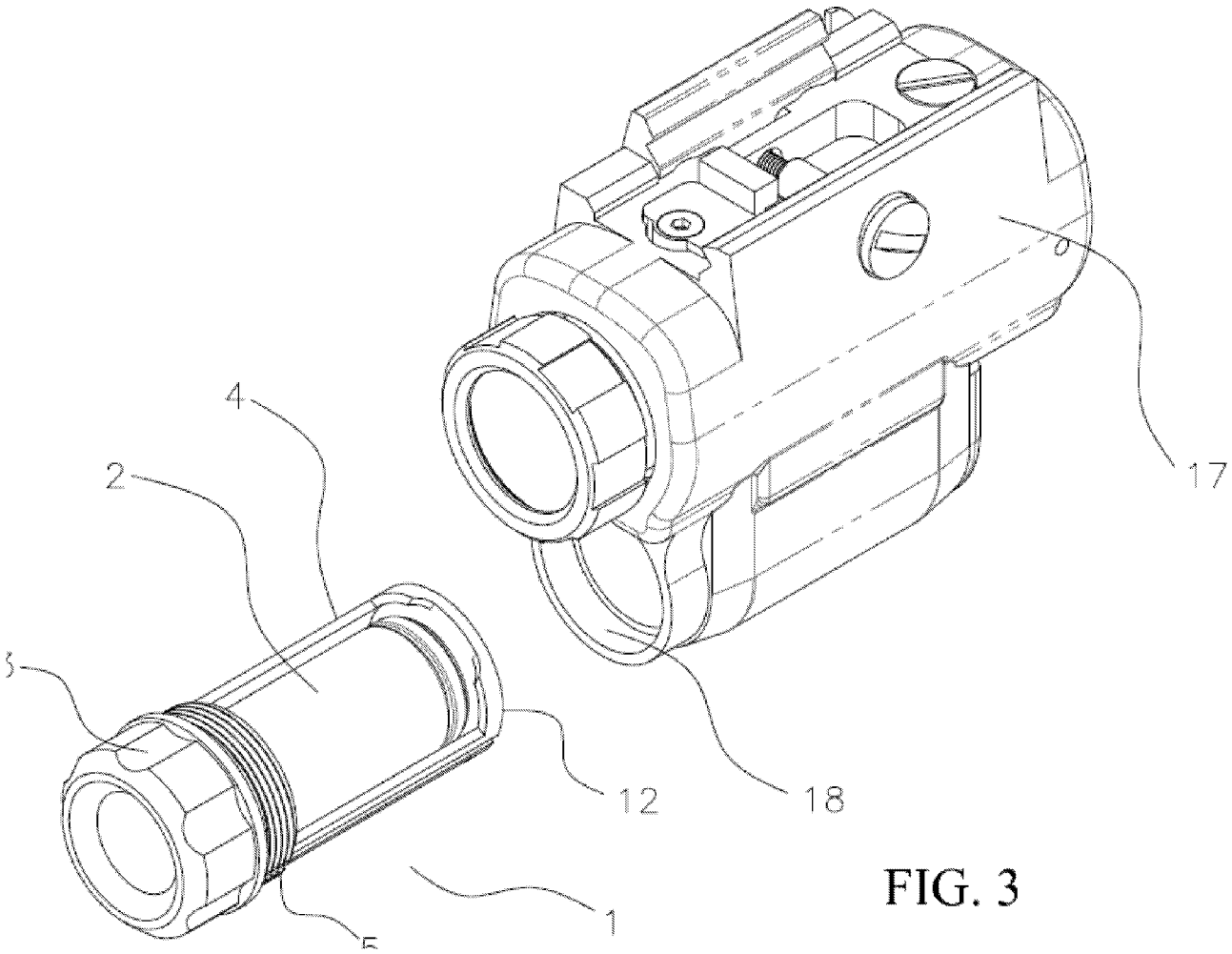
FIG. 3 is a perspective view of the modular power supply of FIG. 1 positioned for installation in a weapon-mountable designator/illuminator unit.

Referring again to FIGS. 1 and 2, the modular power supply 1 is depicted as making use of a battery 2 as a power source, for example, a commercially available lithium battery or the like. The modular power supply 1 is configured so that the battery 2 is installed in a compartment 9 between an end cap 3 and an end wall 12 of a cage 4. The end cap 3 is preferably constructed of an electrically nonconductive material, for example, a polymer or a metal that has been plated or coated with an electrically nonconductive material. The end cap 3 is fixedly attached to one end of the cage 4, for example, permanently attached through press fitting or threading with the addition of a thread-locking adhesive. The cage 4 can be constructed of an electrically conductive material that is partially coated or plated with an electrically nonconductive material so that the majority of its surfaces are nonconductive, with the exception of threads 5 at one end of the cage 4 and a pocket 8 defined in the end wall 12 at the opposite end of the cage 4. The battery 2 is inserted into the cage compartment 9 such that its negative terminal 6 is positioned as shown for contacting a spring 11 that is electrically connected to the threads 5 of the cage 4, and its positive terminal 7 makes contact with an electrically-conductive positive pad 16 located within the pocket 8 in the end wall 12 of the cage 4. The positive pad 16 is preferably part of a contact PCB 13 that is permanently inserted via an interference fitting and/or adhesive within a bore 14 in the end wall 12. Also provided on the contact PCB 13 is a separate electrically-conductive negative pad 15. Recesses 10 in the end wall 12 prevent reverse polarity damage by preventing electrical contact between the negative terminal 6 of the and the positive pad 16 within the pocket 8 of the cage 4 in the event that the battery 2 is installed backwards in the compartment 9. As evident from FIG. 3, the modular power supply 1 of FIGS. 1 and 2 is positioned for assembly with the weapon-mountable designator/illuminator unit 17. The end wall 12 is inserted into a bore 18 of the designator/illuminator unit 17 so that the threads 5 and pads 15 and 16 make appropriate electrical contacts with the electrical circuitry (not shown) within the designator/illuminator unit 17 by which the light source within the unit 17 can be, in preferred embodiments of the invention, exclusively powered by the battery 2 of the power supply 1.

Figure 4:
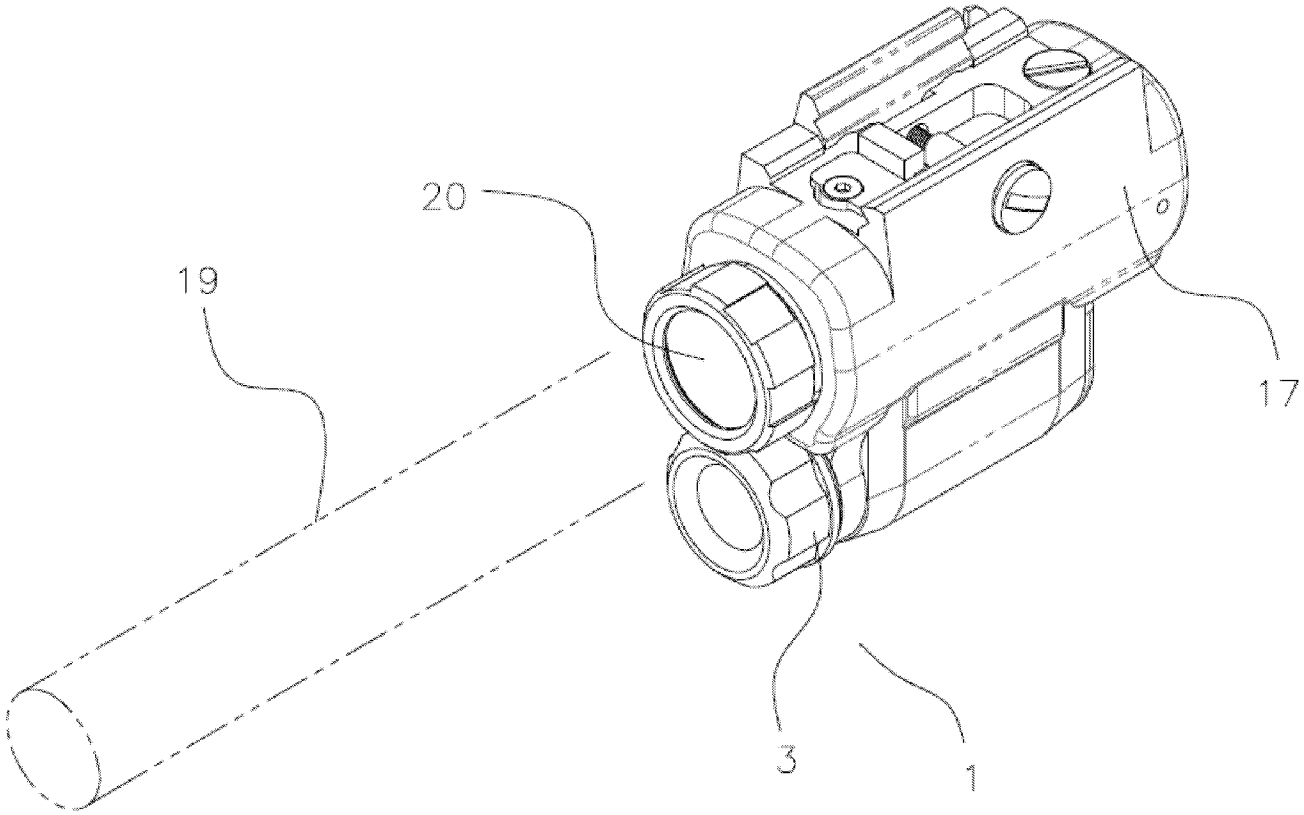
FIG. 4 is a perspective view showing the weapon-mountable designator/illuminator unit of FIG. 3 producing a collimated designator-style light beam following installation of the modular power supply of FIGS. 1 through 3.

FIG. 4 depicts the modular power supply 1 as installed in the designator/illuminator unit 17 so that the end wall 12 of the power supply 1 is received within the bore 18, the end cap 3 remains exposed, and the unit 17 is powered by the modular power supply 1. The unit 17 is represented as being operated to emit the collimated coherent designator-style light beam 19 through an aperture 20 that faces the same direction as the end cap 3 from the unit 17. The laser light source within the unit 17 is coupled with an optical collimator (not shown) capable of increasing the diameter of the light beam 19 to selectively produce the divergent illuminator-type light beam 23 represented in FIG. 5. As represented in FIG. 5, an exteriorly-mounted bezel 21 on the designator/illuminator unit 17 has been adjusted in the direction 22 shown to create the divergent light beam 23 through aperture 20. FIG. 6 evidences that the bezel 21 can be rotated in either of two directions 24 to obtain either light beam 19 or 23, as well as infinitely variable levels of collimation and divergence therebetween.

In the embodiment of FIGS. 7 and 8, the modular power supply 1 is equipped with an end cap 25 that contains the aforementioned light source adapted to generate the divergent illuminator-type light beam 27. With the exception of the end cap 3 being replaced by the end cap 25 and its light source, the construction of the power supply 1 and its assembly with the designator/illuminator unit 17 can be essentially the same as that described for the embodiment of FIGS. 1 through 6, and therefore these aspects of the embodiment of FIGS. 7 and 8 will not be further described. FIG. 8 is similar to FIG. 6, but further represents the light source of the modular power supply 1 as emitting the divergent illuminator-type light beam 27 through an aperture 26 that faces the same direction as the aperture 20 of the unit 17. As with the light source of the designator/illuminator unit 17, the light source of the power supply 1 in FIGS. 7 and 8 draws its electrical power from the battery 2 of the power supply 1.

In the embodiment of FIGS. 9 and 10, the modular power supply 1 is equipped with an end cap 28 that contains the aforementioned light source adapted to generate the highly-collimated designator-type light beam 29. With the exception of the different light source and a smaller aperture 30 through which the beam 29 is emitted, the construction of the power supply 1 and its assembly with the designator/illuminator unit 17 can be essentially the same as that for FIGS. 7 and 8 and therefore will not be further described. As with the light source of the designator/illuminator unit 17, the light source of the power supply 1 in FIGS. 9 and 10 draws its electrical power from the battery 2 of the power supply 1. As previously noted, the wavelength of the highly-collimated designator-type light beam 29 can be chosen to be distinguishable from the wavelength of the light beams 19 and 23 emitted by the designator/illuminator unit 17.

By comparing FIGS. 8 and 10, it should be readily evident that, because the light beams 19, 23, 27 and 29 are all emitted in the same direction relative to the unit 17, various combinations of light beams 19, 23, 27 and 29 can be generated with the designator/illuminator unit 17 and modular power supply 1 and used to designate and/or illuminate a target in a manner capable of vastly increasing the versatility of a weapon used in multiple different tactical missions. As an example, in FIG. 8 the diverging light beam 27 of the power supply 1 can be seen to overlap each of the light beams 19 and 23 generated by the light source of the designator/illuminator unit 17, such that a greater target area can be illuminated around a single target designated by the collimated light beam 19. In contrast, FIG. 10 shows that the highly-collimated light beam 29 of the power supply 1 as overlapping the diverging light beam 23 but not the collimated light beam 19 generated by the light source of the designator/illuminator unit 17, such that the diverging light beam 23 illuminates a target area within which two targets are designated by the collimated light beams 19 and 29.

While the invention has been described in terms of preferred embodiments, it is apparent that other forms could be adopted by one skilled in the art. For example, the modular power supply 1 and designator/illuminator unit 17 could differ in appearance and construction from the embodiments shown in the Figures, the functions of each component of the modular power supply 1 and designator/illuminator unit 17 could be performed by components of different construction but capable of a similar (though not necessarily equivalent) function, and appropriate materials could be substituted for those noted. Therefore, the scope of the invention is to be limited only by the following claims.

The invention claimed is:

1. A method of using a weapon-mountable designator/illuminator unit adapted for mounting on a weapon, the designator/illuminator unit comprising a light source adapted to generate a light beam emitted in a direction away from the designator/illuminator unit and is variable between a collimated light beam and a divergent light beam for, respectively, designating a target and illuminating a target area of the weapon, the designator/illuminator unit comprising at least a first modular power supply, the first modular power supply comprising:

a cage having first and second ends and defining a compartment therebetween that is adapted to receive a power source, the first end of the cage being adapted to be received within the designator/illuminator unit when the first modular power supply is assembled therewith; and an end cap affixed to the second end of the cage and adapted to be exposed when the first modular power supply is assembled with the designator/illuminator unit;

wherein the first modular power supply is adapted to deliver power from the power source to the light source of the designator/illuminator unit, the method comprising:

operating the light source of the designator/illuminator unit with the power source of the first modular power supply to generate the light beam;

varying the light beam between the collimated light beam and the divergent light beam to, respectively, designate a target and illuminate a target area of the weapon;

removing the first modular power supply from the designator/illuminator unit;

installing a second modular power supply in the designator/illuminator unit; and operating the light source of the designator/illuminator unit with a power source of the second modular power supply to generate the light beam.

* * * * *